US009045856B2

(12) United States Patent
Hachisuka et al.

(10) Patent No.: US 9,045,856 B2
(45) Date of Patent: Jun. 2, 2015

(54) HYBRID ROPE AND METHOD FOR MANUFACTURING THE SAME

(75) Inventors: Shunji Hachisuka, Tokyo (JP); Yoichi Shuto, Tokyo (JP); Ippei Furukawa, Tokyo (JP); Jaeduk Im, Pohang-si (KR); Jong-Eun Kim, Busan-si (KR)

(73) Assignees: Tokyo Rope Manufacturing Co., Ltd., Tokyo (JP); Kiswire, Ltd., Busan-si (KR)

( * ) Notice: Subject to any disclaimer, the term of this patent is extended or adjusted under 35 U.S.C. 154(b) by 265 days.

(21) Appl. No.: 13/697,924

(22) PCT Filed: May 17, 2010

(86) PCT No.: PCT/JP2010/058685

§ 371 (c)(1),
(2), (4) Date: Nov. 14, 2012

(87) PCT Pub. No.: WO2011/145224

PCT Pub. Date: Nov. 24, 2011

(65) Prior Publication Data

US 2013/0055696 A1 Mar. 7, 2013

(51) Int. Cl.

| | |
|---|---|
| ***D07B 1/06*** | (2006.01) |
| ***D07B 1/00*** | (2006.01) |
| *D07B 1/02* | (2006.01) |

(52) U.S. Cl.

CPC ..... *D07B 1/0686* (2013.01); *D07B 1/005* (2013.01); *D07B 1/025* (2013.01); *D07B 2201/2055* (2013.01); *D07B 2201/2066* (2013.01); *D07B 2201/2068* (2013.01); *D07B 2201/2065* (2013.01); *D07B 2205/205* (2013.01); *D07B 2501/2015* (2013.01); *D07B 2501/2061* (2013.01); *D07B 2201/2037* (2013.01); *D07B 2401/2005* (2013.01)

(58) Field of Classification Search

USPC ..... 57/212, 222

See application file for complete search history.

(56) References Cited

U.S. PATENT DOCUMENTS

| | | | | |
|---|---|---|---|---|
| 1,950,858 | A * | 3/1934 | Metcalf | 57/223 |
| 3,686,855 | A * | 8/1972 | Falcy et al. | 57/220 |

(Continued)

FOREIGN PATENT DOCUMENTS

| | | |
|---|---|---|
| CN | 101688359 A | 3/2010 |
| JP | 62-129098 | 8/1987 |

(Continued)

OTHER PUBLICATIONS

International Search Report (ISR) (PCT Form PCT/ISA/210) dated Jun. 15, 2010, in PCT/JP2010/058685.

(Continued)

*Primary Examiner* — Shaun R Hurley

(74) *Attorney, Agent, or Firm* — McGinn IP Law Group, PLLC

(57) ABSTRACT

An object of the invention is to provide a high strength and light hybrid rope. At the center of the hybrid rope 1, there is arranged a high strength synthetic fiber rope 3 formed by braiding multiple high strength synthetic fiber bundles 30 each composed of multiple high strength synthetic fiber filaments 31. Given that the pitch of braid of the high strength synthetic fiber bundles 30 is represented by "L" and the diameter of the high strength synthetic fiber rope 3 is represented by "d", the pitch of braid "L" and the diameter "d" are adjusted such that the value L/d is equal to or higher than 6.7.

14 Claims, 7 Drawing Sheets

(56) References Cited

U.S. PATENT DOCUMENTS

| | | | | | |
|---|---|---|---|---|---|
| 3,977,174 | A | * | 8/1976 | Boileau | 57/212 |
| 4,034,547 | A | * | 7/1977 | Loos | 57/211 |
| 4,219,995 | A | * | 9/1980 | Tajima et al. | 57/220 |
| 4,226,078 | A | * | 10/1980 | Ohta et al. | 57/213 |
| 4,412,474 | A | * | 11/1983 | Hara | 87/6 |
| 4,640,179 | A | * | 2/1987 | Cameron | 87/6 |
| 4,878,343 | A | * | 11/1989 | Weidenhaupt et al. | 57/222 |
| 4,887,422 | A | | 12/1989 | Klees et al. | |
| 5,651,245 | A | * | 7/1997 | Damien | 57/220 |
| 6,334,293 | B1 | * | 1/2002 | Poethke et al. | 57/210 |
| 6,563,054 | B1 | * | 5/2003 | Damien et al. | 174/120 C |
| 8,079,208 | B2 | * | 12/2011 | Volpi | 57/222 |
| 8,375,692 | B2 | * | 2/2013 | Rebouillat et al. | 57/210 |
| 8,800,257 | B2 | * | 8/2014 | Rebouillat et al. | 57/212 |

FOREIGN PATENT DOCUMENTS

| | | | |
|---|---|---|---|
| JP | 64-68585 | | 3/1989 |
| JP | 3-124888 | A | 5/1991 |
| JP | 10-140490 | A | 5/1998 |
| JP | 2007-119961 | A | 5/2007 |

OTHER PUBLICATIONS

Chinese Office Action dated Jun. 26, 2014 with an English translation thereof.

* cited by examiner

| L/d | TENSILE STRENGTH (g/d) | STRENGTH USE EFFICIENCY (%) |
|---|---|---|
| 5.9 | 11.2 | 40.0% |
| 9.7 | 18.1 | 64.5% |
| 10.0 | 18.2 | 65.0% |
| 13.3 | 17.5 | 62.4% |
| 13.5 | 18.3 | 65.5% |
| 13.6 | 18.8 | 67.1% |
| 16.7 | 16.9 | 60.3% |
| 16.9 | 19.5 | 69.8% |
| 21.3 | 18.2 | 65.2% |

| L/d | ELONGATION (%) |
|---|---|
| 5 | 6 |
| 6.7 | 5.4 |
| 10 | 4.6 |
| 13 | 4 |
| 16 | 3 |

HYBRID ROPE AND METHOD FOR MANUFACTURING THE SAME

TECHNICAL FIELD

The present invention relates to a hybrid rope used for crane running ropes, ship mooring ropes, and other applications, and to a method for manufacturing such a hybrid rope.

BACKGROUND ART

Wire ropes are used as running ropes and mooring ropes. FIG. 7 shows a conventionally typical steel wire rope used for running ropes and mooring ropes. The steel wire rope 50 includes an IWRC (Independent Wire Rope Core) 51 arranged at the center thereof and six steel side strands 52 formed in a manner laid around the IWRC 51. The IWRC 51 is formed by laying seven steel strands 53.

U.S. Pat. No. 4,887,422 discloses a hybrid rope including not an IWRC 51 but rather a fiber rope arranged at the center thereof and multiple steel strands laid around the fiber rope. Fiber ropes are lighter than IWRCs and therefore the hybrid rope is lighter than steel wire ropes.

Generally in fiber ropes, the ratio of the tensile strength of a fiber rope to the tensile strength of a filament (a single fiber or a line element) included in the fiber rope (strength use efficiency) is low. That is, the tensile strength of a fiber rope formed by laying many fiber filaments is lower than the tensile strength of one of the fiber filaments. For this reason, using not an IWRC but rather a fiber rope may result in that the tensile strength does not reach that of steel wire ropes of the same diameter including an IWRC.

SUMMARY OF THE INVENTION

An object of the present invention is to provide a hybrid rope exhibiting a tensile strength equal to or higher than that of steel wire ropes including an IWRC.

Another object of the present invention is to provide a hybrid rope not to cause damage readily in a fiber rope.

The present invention is directed to a hybrid rope including a high strength synthetic fiber core and multiple side strands each formed by laying multiple steel wires and laid on the outer periphery of the high strength synthetic fiber core, in which the high strength synthetic fiber core comprises a high strength synthetic fiber rope formed by braiding multiple high strength synthetic fiber bundles each composed of multiple high strength synthetic fiber filaments, and in which given that the pitch of braid of the high strength synthetic fiber bundles is represented by "L" and the diameter of the high strength synthetic fiber rope is represented by "d", the value L/d is equal to or higher than 6.7.

The high strength synthetic fiber rope is formed by braiding multiple high strength synthetic fiber bundles. The high strength synthetic fiber bundles are each formed by bundling multiple high strength synthetic fiber filaments such as aramid fibers, ultrahigh molecular weight polyethylene fibers, polyarylate fibers, PBO fibers, or carbon fibers. In the present invention, the high strength synthetic fiber rope is formed using synthetic fiber filaments each having a tensile strength of 20 g/d (259 kg/mm$^2$) or higher. When the hybrid rope is applied with a tensile force, the high strength synthetic fiber rope, which is formed by braiding multiple high strength synthetic fiber bundles, contracts a little bit (radially) inward. Since the contraction is caused by a uniform force, the shape of the high strength synthetic fiber rope, that is, the cross-sectionally circular shape can be maintained to exhibit a high shape maintaining effect.

Multiple side strands are laid on the outer periphery of the high strength synthetic fiber rope. The side strands are each formed by laying multiple steel wires. The multiple side strands may be laid on the outer periphery of the high strength synthetic fiber rope in an ordinary lay or Lang's lay. The number of the high strength synthetic fiber filaments forming each high strength synthetic fiber bundle and the number of the high strength synthetic fiber bundles forming the high strength synthetic fiber rope are defined according to, for example, the diameter required for the hybrid rope.

The high strength synthetic fiber rope has a smaller weight and elastic coefficient and therefore higher fatigue strength than steel wire rope cores (e.g. IWRCs) of the same diameter. That is, the high strength synthetic fiber rope is light, easy to bend, and less likely to fatigue against repetitive applications of tension and bend. The hybrid rope employing such a high strength synthetic fiber rope is also light and offers high flexibility and durability.

In general, the tensile strength of fiber ropes including high strength synthetic fiber ropes varies depending on the angle of lay (tilt angle with respect to the rope axis) of fiber bundles forming the fiber rope. The smaller the angle of lay of the fiber bundles, the higher the tensile strength of the fiber rope becomes, while the greater the angle of lay of the fiber bundles, the lower the tensile strength of the fiber rope becomes. The angle of lay of fiber bundles is proportional to the pitch of lay or braid of the fiber bundles and inversely proportional to the diameter of the fiber rope.

The hybrid rope according to the present invention is characterized in that given that the pitch of braid of the high strength synthetic fiber bundles forming the high strength synthetic fiber rope provided at the center of the hybrid rope is represented by "L" and the diameter of the high strength synthetic fiber rope is represented by "d", the value L/d is equal to or higher than 6.7. Since the diameter "d" of the high strength synthetic fiber rope is defined according to, for example, the diameter of the hybrid rope to be provided as a final product, the value L/d is generally adjusted by the pitch of braid "L" of the high strength synthetic fiber bundles.

The longer the pitch of braid "L" of the high strength synthetic fiber bundles, that is, the higher the value L/d, the smaller the angle of lay of the high strength synthetic fiber bundles and thereby the higher the tensile strength of the high strength synthetic fiber rope becomes. That is, braiding multiple high strength synthetic fiber bundles at a long pitch of braid "L" can result in a high strength synthetic fiber rope with a high tensile strength and therefore a hybrid rope with a high tensile strength including the high strength synthetic fiber rope.

It was confirmed by a tensile test that the high strength synthetic fiber rope formed by braiding multiple high strength synthetic fiber bundles such that the value L/d is equal to or higher than 6.7 offered a tensile strength equal to or higher than that of steel wire ropes (e.g. IWRCs) of the same diameter formed by laying multiple steel wires. The hybrid rope according to the present invention having a high strength synthetic fiber rope formed by braiding multiple high strength synthetic fiber bundles such that the value L/d is equal to or higher than 6.7 offers a tensile strength equal to or higher than that of conventional steel wire ropes (see FIG. 7) of the same diameter, and additionally is light and offers high flexibility and durability, as mentioned above.

It was also confirmed by a tensile test that if the value L/d is equal to or higher than 6.7, the ratio of the tensile strength of the high strength synthetic fiber rope to the tensile strength of the high strength synthetic fiber filament (strength use efficiency) is 50% or more. The present invention can increase the strength use efficiency of the high strength synthetic fiber rope and accordingly the tensile strength of the hybrid rope.

The higher the value L/d (i.e. the longer the pitch of braid "L" of the high strength synthetic fiber bundles), the higher the tensile strength of the high strength synthetic fiber rope becomes as mentioned above, while on the contrary, the lower the degree of elongation (elongation before fracture) of the high strength synthetic fiber rope becomes. If the degree of elongation of the high strength synthetic fiber rope within the hybrid rope is lower than the degree of elongation of the steel side strands arranged outermost in the hybrid rope, only the high strength synthetic fiber rope may fracture within the hybrid rope during the use of the hybrid rope. To address this problem, the degree of elongation of the high strength synthetic fiber rope is preferably equal to or higher than the degree of elongation of the side strands.

The degree of elongation of the high strength synthetic fiber rope also depends on the value L/d. High strength synthetic fiber ropes with a lower value of L/d (i.e. with a shorter pitch of braid "L") structurally exhibit a higher degree of longitudinal elongation, while high strength synthetic fiber ropes with a higher value of L/d (i.e. with a longer pitch of braid "L") structurally exhibit a lower degree of longitudinal elongation. Therefore, the degree of elongation of the high strength synthetic fiber rope can also be adjusted by the pitch of braid "L" of the high strength synthetic fiber bundles.

The value L/d is preferably limited to be equal to or lower than 13. It was confirmed by a tensile test that the high strength synthetic fiber rope, if the value L/d is equal to or lower than 13, exhibited an elongation of 4% or more. The degree of elongation of steel side strands used in hybrid ropes is generally 3 to 4%. If the value L/d is 13 as mentioned above, the high strength synthetic fiber rope exhibits an elongation of 4%, approximately the same as the degree of elongation of the side strands. If the value L/d is lower than 13, the degree of elongation of the high strength synthetic fiber rope becomes higher than the degree of elongation of the side strands. This can reduce the possibility that only the high strength synthetic fiber rope may fracture within the hybrid rope during the use of the hybrid rope. It will be understood that the value L/d may be even lower (e.g. limited to be equal to or lower than 10) to further reduce the possibility that only the high strength synthetic fiber rope may fracture within the hybrid rope during the use of the hybrid rope.

In an implementation, the high strength synthetic fiber core further comprises a braided sleeve formed by braiding multiple fiber bundles each composed of multiple fiber filaments and covering the outer periphery of the high strength synthetic fiber rope. Each fiber bundle included in the braided sleeve is formed by bundling many synthetic fibers (high strength synthetic fibers or common synthetic fibers) or natural fiber filaments. The braided sleeve is formed in a manner arranged cross-sectionally on the outer periphery of the high strength synthetic fiber rope. When the hybrid rope is applied with a tensile force, the braided sleeve contracts (radially) inward to squeeze on the outer periphery of the high strength synthetic fiber rope with a uniform force. Thus, the shape of the high strength synthetic fiber rope, that is, the cross-sectionally circular shape can also be maintained by the braided sleeve to prevent the local deformation (loss of shape) of the high strength synthetic fiber rope and therefore the deterioration of the tensile strength. In addition, the braided sleeve can prevent the high strength synthetic fiber rope from being scratched or damaged.

In another implementation, the high strength synthetic fiber core further comprises a resin layer covering the outer periphery of the braided sleeve. The outer periphery of the braided sleeve is thus covered with, for example, a synthetic plastic resin layer. The resin layer can absorb or reduce impact forces, if may be applied, to further prevent the high strength synthetic fiber rope from being damaged or deformed.

The resin layer preferably has a thickness of 0.2 mm or more. The resin layer, if too thin, may rapture. With a thickness of 0.2 mm or more, impact forces applied to the high strength synthetic fiber rope provided at the center of the hybrid rope can be absorbed or reduced sufficiently.

If the resin layer is too thick while the diameter of the hybrid rope is specified as a final product, the high strength synthetic fiber rope is inevitably required to have a relatively small diameter. The cross-sectional area of the resin layer preferably accounts for less than 30% of the cross-sectional area of the high strength synthetic fiber core, which consists of three layers: high strength synthetic fiber rope, braided sleeve, and resin layer. That is, given that the cross-sectional area of the resin layer is represented by D1 and the cross-sectional area of the high strength synthetic fiber core is represented by D2, the value D1/D2 is lower than 0.3. As a final product, the hybrid rope can offer a predetermined tensile strength because the high strength synthetic fiber rope accounts for a higher percentage of the high strength synthetic fiber core.

A high strength synthetic fiber rope may be arranged not only at the center of the hybrid rope but also at the center of each of the multiple side strands outermost in the hybrid rope. In an implementation, a high strength synthetic fiber rope is arranged at the center of each of the multiple side strands. This allows the hybrid rope to have a smaller weight and also a higher resistance to fatigue. It will be understood that the high strength synthetic fiber rope arranged at the center of each side strand may also be covered with a resin layer. Further, such a braided sleeve as mentioned above may be formed between the outer periphery of the high strength synthetic fiber rope arranged at the center of each side strand and the resin layer.

Also in each of the multiple side strands, the cross-sectional area of the resin layer preferably accounts for less than 30% of the cross-sectional area of the three layers: high strength synthetic fiber rope, braided sleeve, and resin layer. That is, given that the cross-sectional area of the resin layer is represented by D3, the cross-sectional area of the high strength synthetic fiber rope is represented by D4, and the cross-sectional area of the braided sleeve is represented by D5 in each of the multiple side strands, the value D3/(D3+D4+D5) is lower than 0.3.

In an implementation, the side strands are prepared in Seale form. Compared to Warrington form, the inner peripheral portion in Seale form has a cross-section closer to a circle. The cross-sectionally circular shape of the high strength synthetic fiber rope arranged at the center of each side strand can be maintained to prevent the deformation (loss of shape) of the rope and therefore the deterioration of the tensile strength.

The present invention is also directed to a method for manufacturing such a hybrid rope as mentioned above in which multiple side strands each formed by laying multiple steel wires are laid on the outer periphery of a high strength synthetic fiber rope formed by braiding multiple high strength synthetic fiber bundles each composed of multiple high strength synthetic fiber filaments, in which the pitch of braid "L" of the high strength synthetic fiber bundles is adjusted such that the tensile strength of the high strength synthetic fiber rope is equal to or higher than the tensile strength of a steel wire rope of the same diameter and the degree of elongation of the high strength synthetic fiber rope is equal to or higher than the degree of elongation of the side strands.

BEST MODE FOR CARRYING OUT THE INVENTION

Figure 1:
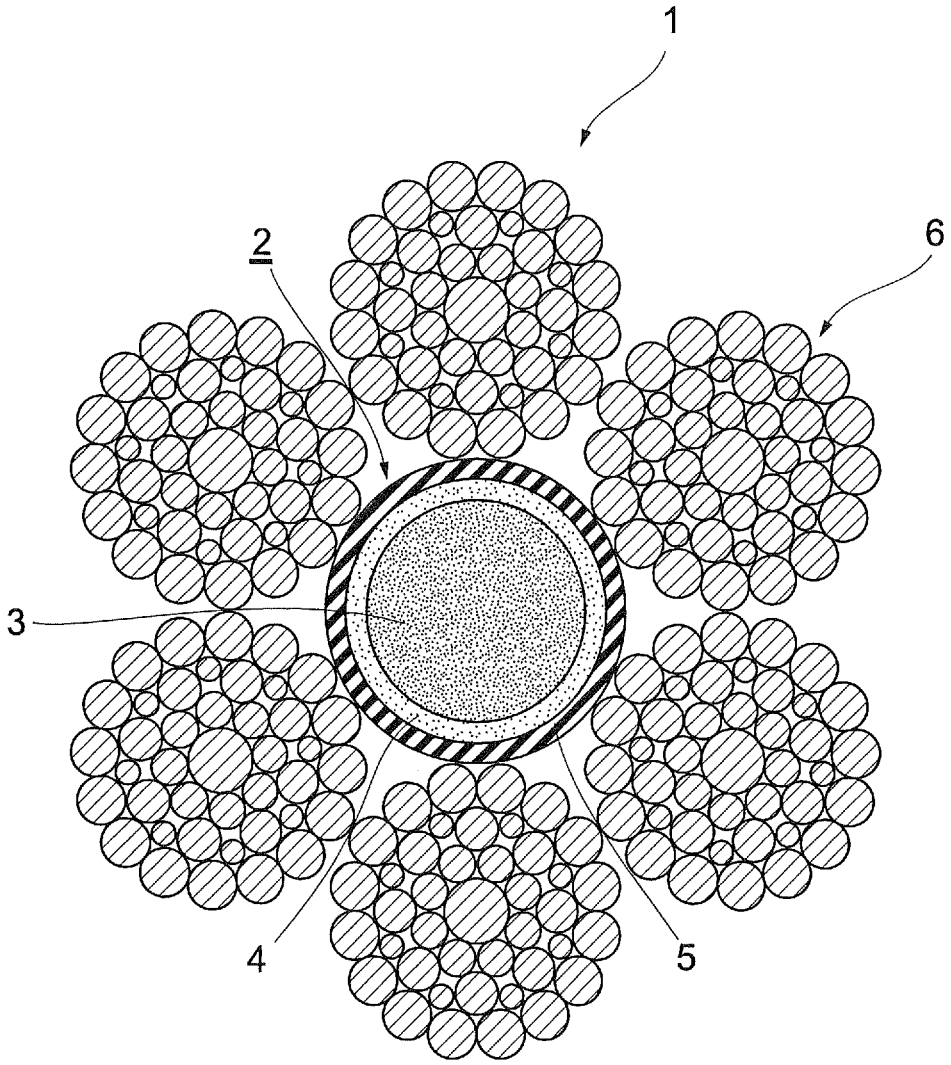
FIG. 1 is a cross-sectional view of a hybrid rope according to a first embodiment.
Figure 2:
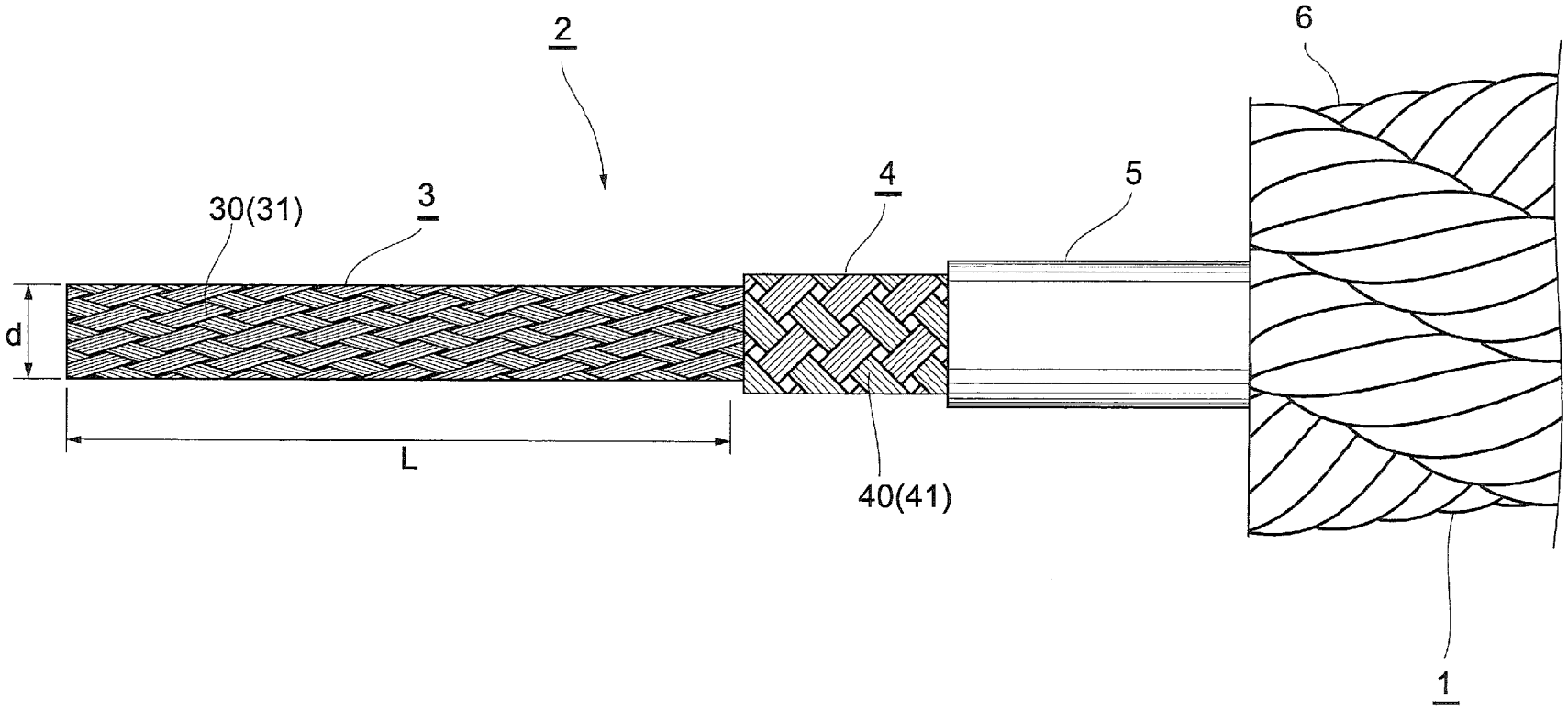
FIG. 2 is a front view of the hybrid rope according to the first embodiment.

FIG. 1 is a cross-sectional view of a hybrid rope according to a first embodiment. FIG. 2 is a plan view of the hybrid rope shown in FIG. 1, with a fiber rope, a braided sleeve, and a resin layer included in a core at the center of the hybrid rope being partially exposed. For the sake of illustrative convenience, the scale ratio differs between FIGS. 1 and 2.

The hybrid rope 1 includes a high strength synthetic fiber core 2, called Super Fiber Core (hereinafter referred to as SFC 2), containing high strength synthetic aramid fibers and six steel side strands 6 formed in a manner laid around the SFC 2. The SFC 2 is arranged cross-sectionally at the center of the hybrid rope 1. Both the hybrid rope 1 and the SFC 2 have an approximately circular cross-sectional shape.

The SFC 2 includes a high strength synthetic fiber rope 3 arranged at the center thereof and surrounded by a braided sleeve 4. The outer periphery of the braided sleeve 4 is further covered with a resin layer 5.

The high strength synthetic fiber rope 3 is formed by preparing multiple sets of two bundles of multiple high strength aramid fiber filaments 31 (hereinafter referred to as high strength synthetic fiber bundles 30) and braiding the multiple high strength synthetic fiber bundles 30. Given that the pitch of braid of the high strength synthetic fiber bundles 30 (length for one winding of the braided high strength synthetic fiber bundles 30) is represented by "L" and the diameter of the high strength synthetic fiber rope 3 is represented by "d", the value L/d is within the range of $6.7 \leq L/d \leq 13$. FIG. 2 shows a case where the value L/d is approximately 7.0. The technical meaning of limiting the value L/d within the range will hereinafter be described in detail.

Figure 7:
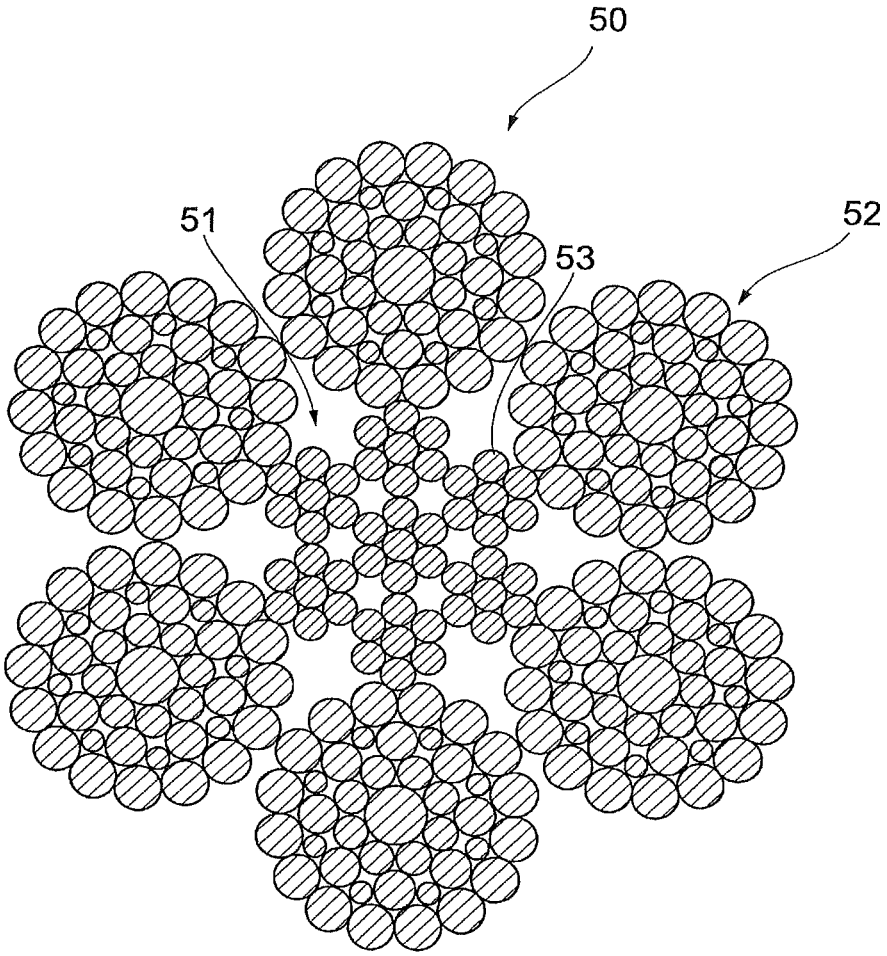
Fig. 7 RELATED ART
FIG. 7 is a cross-sectional view of a wire rope having a conventional structure.

The high strength synthetic fiber rope 3 has a smaller weight and elastic coefficient and therefore higher fatigue strength than steel wire rope cores (e.g. IWRCs) (see FIG. 7) of the same diameter. The hybrid rope 1 employing such a high strength synthetic fiber rope 3 is also light and offers high flexibility and durability. Also, the high strength synthetic fiber rope 3, which is formed by braiding multiple high strength synthetic fiber bundles 30, structurally exhibits a longitudinal elongation and, when a tensile force is applied, contracts (radially) inward with a uniform force. Therefore, the shape of the high strength synthetic fiber rope 3, that is, the cross-sectionally circular shape is likely to be maintained during the use of the hybrid rope 1.

The braided sleeve 4 is formed by braiding multiple polyester fiber bundles 40 around the outer periphery of the high strength synthetic fiber rope 3. Each polyester fiber bundle 40 is formed by bundling multiple polyester fiber filaments 41. The braided sleeve 4 is formed cross-sectionally in an approximately circular shape along the outer periphery of the high strength synthetic fiber rope 3. The braided sleeve 4 can prevent the high strength synthetic fiber rope 3 from being scratched, damaged, or fractured.

The whole length of the outer periphery of the high strength synthetic fiber rope 3 is surrounded by the braided sleeve 4. The braided sleeve 4, which is formed by braiding polyester fiber bundles 40, contracts (radially) inward, when a tensile force is applied, to squeeze on the outer periphery of the high strength synthetic fiber rope 3 with a uniform force. Therefore, the shape of the high strength synthetic fiber rope 3 is likely to be maintained also by the braided sleeve 4 during the use of the hybrid rope 1. This can prevent the high strength synthetic fiber rope 3 from being locally deformed to be likely to fracture thereat.

The whole length of the outer periphery of the braided sleeve 4 is covered with a polypropylene resin layer 5. The resin layer 5 is plastic so as to prevent the high strength synthetic fiber rope 3 from being scratched and absorb or reduce impact forces, if may be applied, to prevent the high strength synthetic fiber rope 3 from being damaged, fractured, or deformed. The resin layer 5 has a thickness of 0.2 mm or more not to rapture during the use of the hybrid rope 1. It will be understood that the resin layer 5 is not required to have an unnecessary thickness and the cross-sectional area thereof preferably accounts for less than 30% of the cross-sectional area of the SFC 2.

Six side strands 6 are laid around the outer periphery of the SFC 2, which has a three-layer structure consisting of the high strength synthetic fiber rope 3, braided sleeve 4, and resin layer 5. Each side strand 6 is formed by laying 41 steel wires in Warrington form (6×WS (41)). Also, each side strand 6 may be laid in an ordinary lay or Lang's lay.

Figures 3A, 3B:
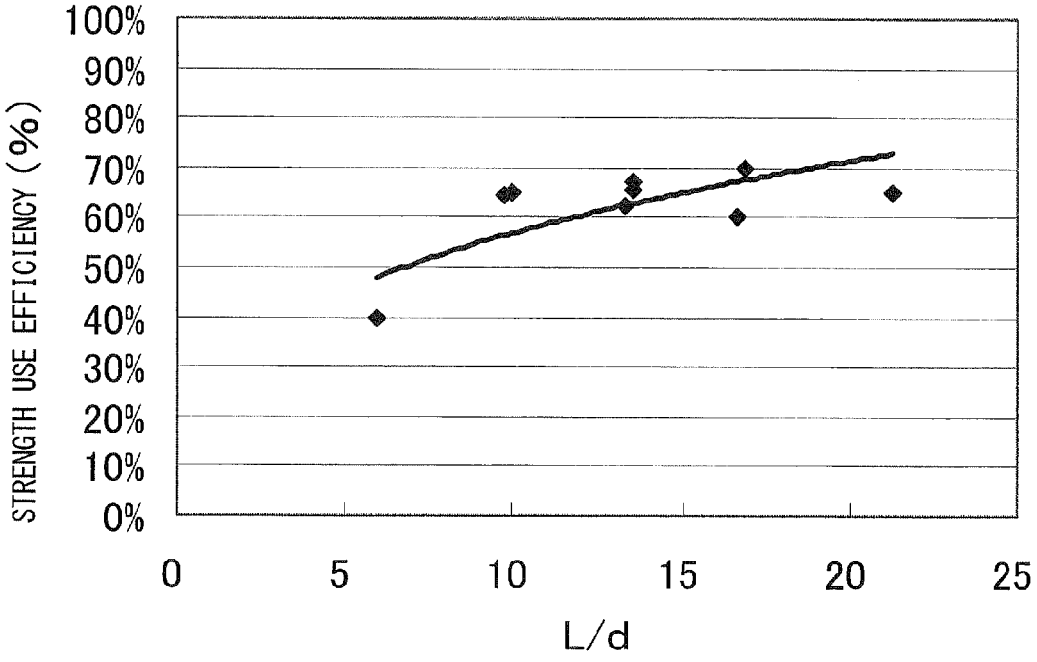
FIGS. 3A and 3B show a tensile test result on a high strength synthetic fiber rope included in the hybrid rope according to the first embodiment.

FIG. 3A shows a tensile test result on the strength use efficiency (strength utilization rate) of the high strength synthetic fiber rope 3. FIG. 3B graphically shows the tensile test result of FIG. 3A, where the vertical axis represents the strength use efficiency (%) while the horizontal axis represents the value L/d. FIG. 3B shows multiple plots based on the tensile test result of FIG. 3A and an approximate curve obtained from these plots.

In the tensile test, multiple (nine in this example) high strength synthetic fiber ropes 3 were prepared having a constant diameter "d" (9.8 mm) and their respective different pitches of braid "L" and cut into a predetermined length. One end of each high strength synthetic fiber rope 3 cut into the predetermined length was fixed, while the other end thereof was pulled. The tensile loading was increased gradually and recorded (as fracture loading) when the high strength synthetic fiber rope 3 fractured. The recorded fracture loading was then divided by the denier value of the high strength synthetic fiber rope 3 to obtain the tensile strength of the high strength synthetic fiber rope 3 (unit: g/d). The high strength synthetic fiber rope 3 for the tensile test was prepared using high strength synthetic fiber filaments 31 having 1500 denier and a tensile strength of 28 g/d. The tensile strength (28 g/d) of the high strength synthetic fiber filament 31 was then divided by the tensile strength of each high strength synthetic fiber rope 3 obtained in the tensile test and multiplied by 100 to obtain a strength use efficiency (unit: %). The strength use efficiency of each high strength synthetic fiber rope 3 represents how efficiently the high strength synthetic fiber rope 3 uses the tensile strength of the high strength synthetic fiber filament 31.

Referring to FIG. 3A, the tensile strength of each high strength synthetic fiber rope 3 is lower than the tensile strength (28 g/d) of the high strength synthetic fiber filament 31 included in the high strength synthetic fiber rope 3.

Referring to FIGS. 3A and 3B, the higher the value L/d, the relatively higher the strength use efficiency is, while the lower the value L/d, the lower the strength use efficiency is. Compared to high strength synthetic fiber ropes 3 with a higher L/d (i.e. with a longer pitch of braid "L" at a constant diameter "d"), the high strength synthetic fiber bundles 30 included in high strength synthetic fiber ropes 3 with a lower L/d (i.e. with a shorter pitch of braid "L" at a constant diameter "d") have a greater angle of lay (tilt angle with respect to the rope axis), which causes the high strength synthetic fiber filaments 31 to be applied with only a weak longitudinal force when pulled. For this reason, high strength synthetic fiber ropes 3 with a lower L/d are considered to have a lower tensile strength and strength use efficiency. It is required to increase the value L/d to obtain a high strength synthetic fiber rope 3 with a higher tensile strength and strength use efficiency.

It was confirmed by the tensile test that adjusting the value L/d (pitch of braid "L") to be equal to or higher than 6.7 offered a tensile strength equal to or higher than the tensile strength (about 14.0 g/d) of steel wire ropes (e.g. IWRCs) (see FIG. 7) of the same diameter. It was also confirmed by the tensile test that high strength synthetic fiber ropes 3 with an L/d value of 6.7 or higher have a strength use efficiency of higher than 50%. The same applies to high strength synthetic fiber ropes 3 having their respective different diameters.

Figures 4A, 4B:
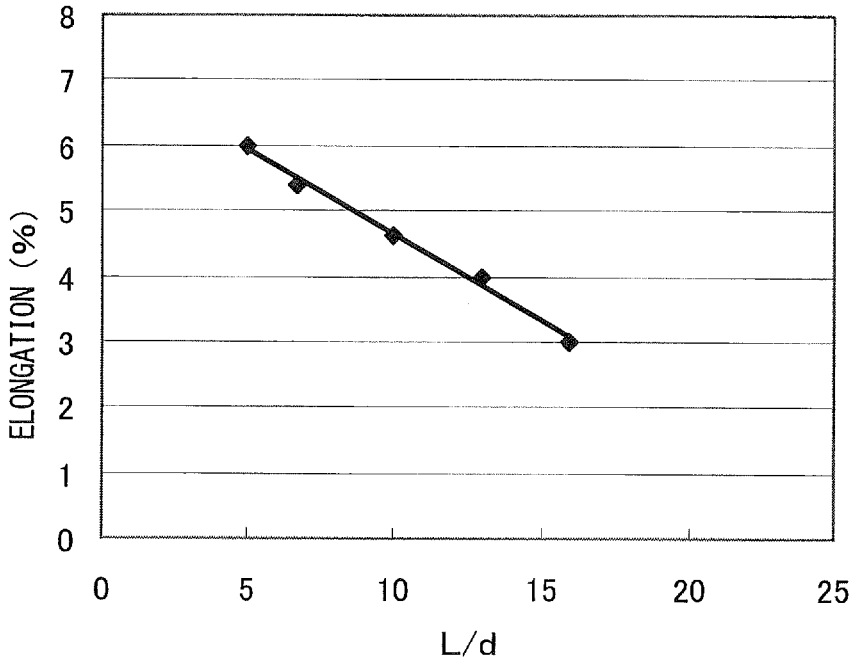
FIGS. 4A and 4B show another tensile test result on the high strength synthetic fiber rope included in the hybrid rope according to the first embodiment.

FIG. 4A shows another tensile test result on the degree of elongation of the high strength synthetic fiber rope 3. FIG. 4B graphically shows the tensile test result of FIG. 4A, where the vertical axis represents the degree of elongation (%) while the horizontal axis represents the value L/d. FIG. 4B shows multiple plots based on the tensile test result of FIG. 4A and an approximate curve obtained from these plots. Also in this tensile test on the degree of elongation, multiple (five in this example) high strength synthetic fiber ropes 3 were prepared having a constant diameter "d" (9.8 mm) and their respective different pitches of braid "L" of the high strength synthetic fiber bundles 30. One end of each high strength synthetic fiber rope 3 cut into a predetermined length was fixed, while the other end thereof was pulled. The tensile loading was increased gradually and, when the high strength synthetic fiber rope 3 fractured, the degree of elongation (%) was measured with respect to the predetermined length before the tensile test.

As mentioned above, the higher the value L/d, the higher the tensile strength and strength use efficiency of the high strength synthetic fiber rope 3 is. However, referring to FIG. 4B, the higher the value L/d, the lower the degree of elongation of the high strength synthetic fiber rope 3 is. This is for the reason that the high strength synthetic fiber bundles 30 included in high strength synthetic fiber ropes 3 with a higher L/d have a smaller angle of lay, resulting in a structurally low degree of elongation. If the degree of elongation of the high strength synthetic fiber rope 3 is low, the high strength synthetic fiber rope 3 may fracture within the hybrid rope 1 during the use of the hybrid rope 1 before the side strands 6. The degree of elongation of the high strength synthetic fiber rope 3 is required to be at least equal to the degree of elongation of the side strands 6 used in the hybrid rope 1.

The degree of elongation of the high strength synthetic fiber rope 3 depends on the value L/d of the high strength synthetic fiber rope 3. The value L/d of the high strength synthetic fiber rope 3 is therefore adjusted such that the degree of elongation of the high strength synthetic fiber rope 3 is equal to or higher than the degree of elongation of the side strands 6 used in the hybrid rope 1. For example, if the degree of elongation of the side strands 6 used in the hybrid rope 1 is 3%, the value L/d of the high strength synthetic fiber rope 3 is adjusted such that the degree of elongation thereof is 3% or higher, or preferably and flexibly 4% or higher. It was confirmed by the tensile test that the degree of elongation of 4% or higher can be achieved with an L/d value of 13 or lower. The L/d value of 13 or lower allows the high strength synthetic fiber rope 3 to have a degree of elongation equal to or higher than that of the side strands 6, which can reduce the possibility that only the high strength synthetic fiber rope 3 may fracture during the use of the hybrid rope 1.

It will be understood that the value L/d may be even lower (e.g. limited to be equal to or lower than 10) to allow the high strength synthetic fiber rope 3 to have a higher degree of elongation reliably. This can further reduce the possibility that the high strength synthetic fiber rope 3 may fracture before the side strands 6.

Figure 5:
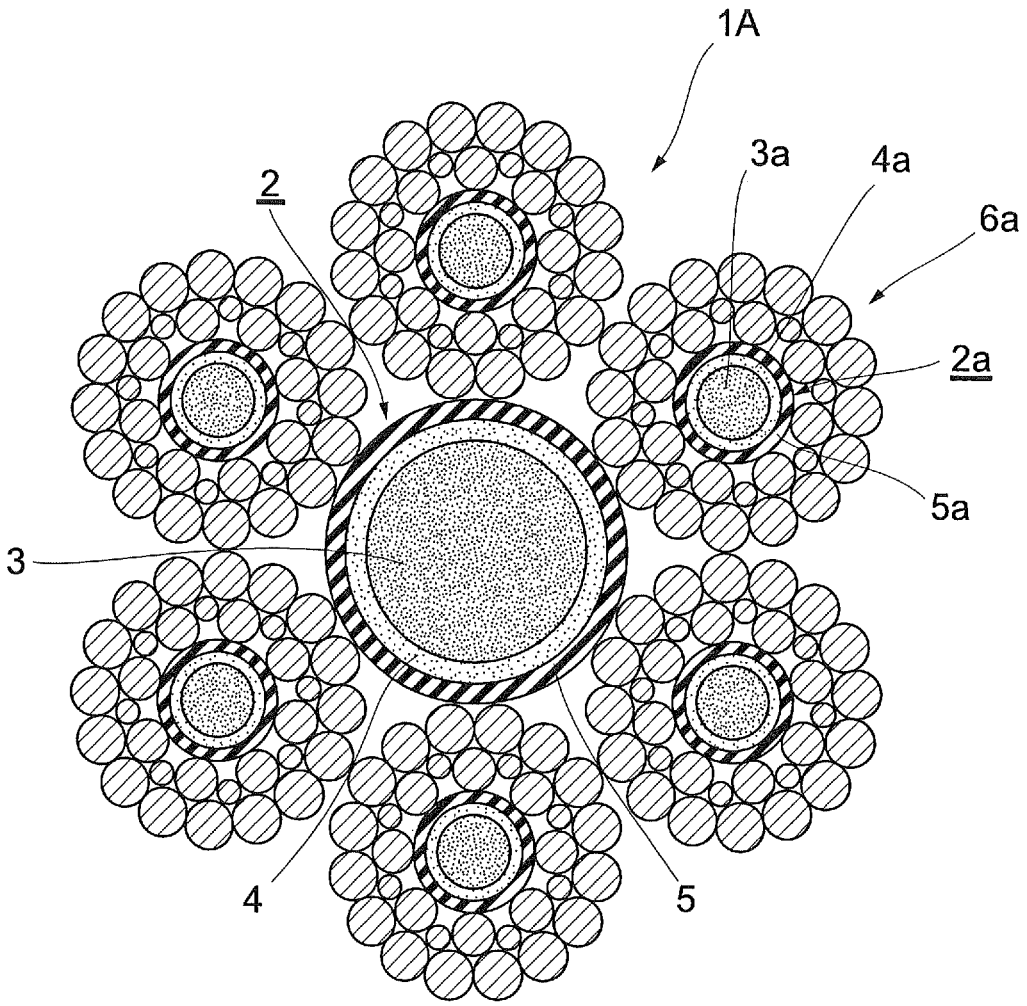
FIG. 5 is a cross-sectional view of a hybrid rope according to a second embodiment.

FIG. 5 is a cross-sectional view of a hybrid rope according to a second embodiment. The hybrid rope 1A according to the second embodiment differs from the hybrid rope 1 according to the first embodiment in that SFC 2*a* is formed not only at the center of the hybrid rope 1A but also at the center of each of the six side strands 6*a*.

Just like SFC 2, the SFC 2*a* provided at the center of each of the six side strands 6*a* also has a three-layer structure consisting of a high strength synthetic fiber rope 3*a*, a braided sleeve 4*a*, and a resin layer 5*a*. Since the weight of the six side strands 6*a* is reduced, the weight of the entire hybrid rope 1A is further reduced. The resin layer 5*a* is not required to have an unnecessary thickness and the cross-sectional area thereof preferably accounts for less than 30% of the cross-sectional area of the SFC 2*a*.

Figure 6:
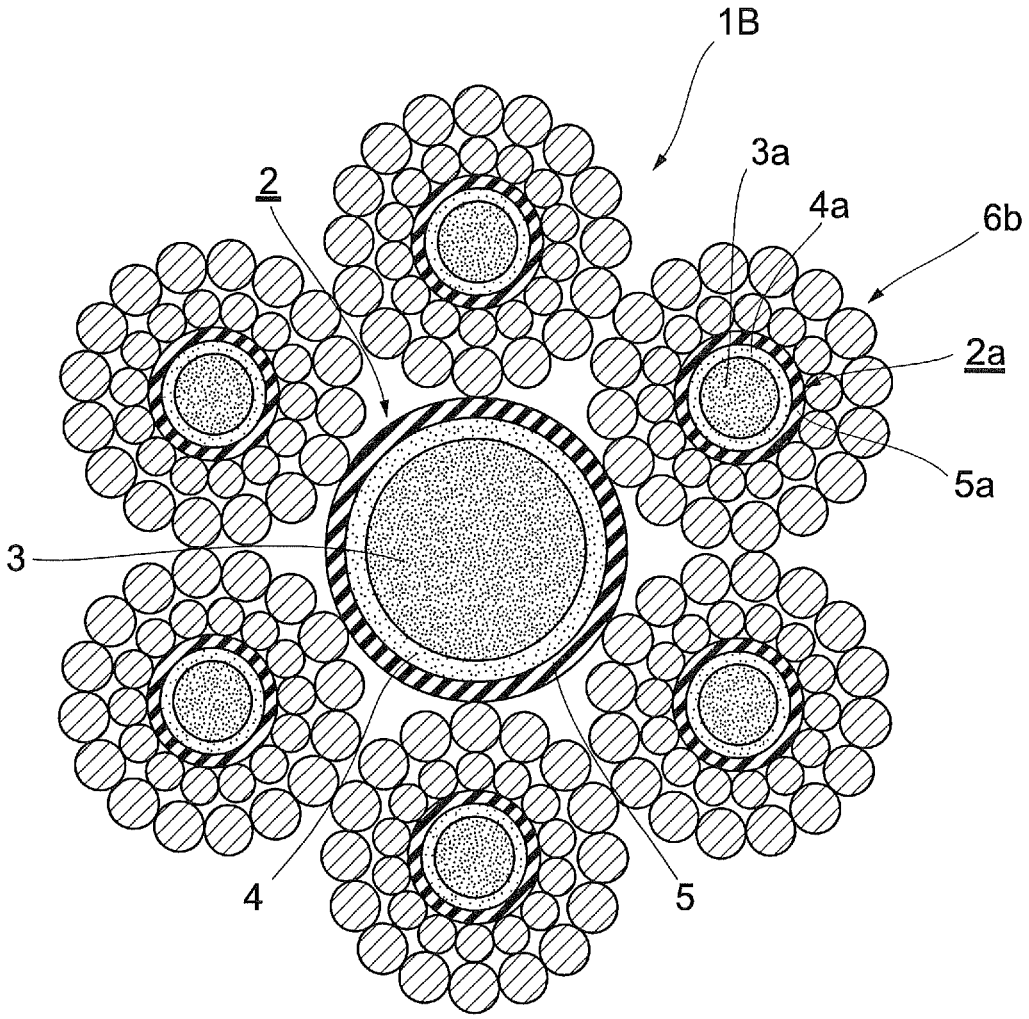
FIG. 6 is a cross-sectional view of a hybrid rope according to a third embodiment.

FIG. 6 is a cross-sectional view of a hybrid rope 1B according to a third embodiment, differing from the hybrid rope 1A (see FIG. 5) according to the second embodiment in that the side strands 6*b* are formed not in Warrington form but in Seale form. In Seale form, the side strands 6*b* come into contact with the SFC 2*a* in a more rounded and uniform manner than in Warrington form, whereby the cross-sectionally circular shape of the high strength synthetic fiber rope 3 is likely to be maintained.

Since the circular shape of the high strength synthetic fiber rope 3 is likely to be maintained in Seale form, in the hybrid rope 1B according to the third embodiment shown in FIG. 6, the SFC 2*a* within each side strand 6*b* may exclude the braided sleeve 4*a* to have a two-layer structure consisting of the high strength synthetic fiber rope 3*a* and the resin layer 5*a*.

Although the above-described hybrid ropes 1, 1A, 1B each include six side strands 6, 6*a*, 6*b*, the number of side strands is not limited to six, but may be seven to ten, for example.

The invention claimed is:

1. A hybrid rope comprising a high strength synthetic fiber core and multiple side strands each formed by laying multiple steel wires and laid on the outer periphery of the high strength synthetic fiber core, wherein the high strength synthetic fiber core comprises a high strength synthetic fiber rope formed by braiding multiple high strength synthetic fiber bundles each composed of multiple high strength synthetic fiber filaments, and wherein given that the pitch of braid of the high strength synthetic fiber bundles is represented by "L" and the diameter of the high strength synthetic fiber rope is represented by "d", the value L/d is equal to or higher than 6.7, the high strength synthetic fiber core further comprises a braided sleeve formed by braiding multiple fiber bundles each composed of multiple fiber filaments and the outer periphery of the high strength synthetic fiber rope is covered with the braided sleeve, and the high strength synthetic fiber core further comprises a resin layer covering the braided sleeve.

2. The hybrid rope according to claim 1, wherein the degree of elongation of the high strength synthetic fiber rope is equal to or higher than the degree of elongation of the side strands.

3. The hybrid rope according to claim 1, wherein the value L/d is equal to or lower than 13.

4. The hybrid rope according to claim 1, wherein given that the cross-sectional area of the resin layer is represented by D1 and the cross-sectional area of the high strength synthetic fiber core is represented by D2, the value D1/D2 is lower than 0.3.

5. The hybrid rope according to claim 1, wherein a high strength synthetic fiber rope formed by braiding multiple high strength synthetic fiber bundles each composed of multiple high strength synthetic fiber filaments is arranged at the center of each of the multiple side strands.

6. The hybrid rope according to claim 4, wherein the high strength synthetic fiber rope arranged at the center of each of the side strands is covered with a resin layer.

7. The hybrid rope according to claim 6, wherein a braided sleeve formed by braiding multiple fiber bundles each composed of multiple fiber filaments is provided between the high strength synthetic fiber rope and the resin layer in each of the multiple side strands.

8. The hybrid rope according to claim 7, wherein given that the cross-sectional area of the resin layer is represented by D3, the cross-sectional area of the high strength synthetic fiber rope is represented by D4, and the cross-sectional area of the braided sleeve is represented by D5 in each of the multiple side strands, the value D3/(D3+D4+D5) is lower than 0.3.

9. A method for manufacturing a hybrid rope in which multiple side strands each formed by laying multiple steel wires are laid on the outer periphery of a high strength synthetic fiber rope formed by braiding multiple high strength synthetic fiber bundles each composed of multiple high strength synthetic fiber filaments, wherein the pitch of braid "L" of the high strength synthetic fiber bundles is adjusted such that the tensile strength of the high strength synthetic fiber rope is equal to or higher than the tensile strength of a steel wire rope of the same diameter and the degree of elongation of the high strength synthetic fiber rope is equal to or higher than the degree of elongation of the side strands, the high strength synthetic fiber core further comprises a braided sleeve formed by braiding multiple fiber bundles each composed of multiple fiber filaments and the outer periphery of the high strength synthetic fiber rope is covered with the braided sleeve, and the high strength synthetic fiber core further comprises a resin layer covering the braided sleeve.

10. The hybrid rope according to claim 2, wherein the value L/d is equal to or lower than 13.

11. The hybrid rope according to claim 2, wherein a high strength synthetic fiber rope formed by braiding multiple high strength synthetic fiber bundles each composed of multiple high strength synthetic fiber filaments is arranged at the center of each of the multiple side strands.

12. The hybrid rope according to claim 3, wherein a high strength synthetic fiber rope formed by braiding multiple high strength synthetic fiber bundles each composed of multiple high strength synthetic fiber filaments is arranged at the center of each of the multiple side strands.

13. The hybrid rope according to claim 4, wherein a high strength synthetic fiber rope formed by braiding multiple high strength synthetic fiber bundles each composed of multiple high strength synthetic fiber filaments is arranged at the center of each of the multiple side strands.

14. A hybrid rope comprising a high strength synthetic fiber core and multiple side strands each formed by laying multiple steel wires and laid on the outer periphery of the high strength synthetic fiber core, wherein the high strength synthetic fiber core comprises a high strength synthetic fiber rope formed by braiding multiple high strength synthetic fiber bundles each composed of multiple high strength synthetic fiber filaments, and wherein given that the pitch of braid of the high strength synthetic fiber bundles is represented by "L" and the diameter of the high strength synthetic fiber rope is represented by "d", the value L/d is equal to or higher than 6.7, a high strength synthetic fiber rope formed by braiding multiple high strength synthetic fiber bundles each composed of multiple high strength synthetic fiber filaments is arranged at the center of each of the multiple side strands, and the high strength synthetic fiber rope arranged at the center of each of the side strands is covered with a resin layer.

* * * * *